US005727817A

United States Patent [19]

Kraige

[11] Patent Number: 5,727,817

[45] Date of Patent: Mar. 17, 1998

[54] DOUBLE-SIDED PEEL OFF COUPON BOOKLET AND METHOD OF MAKING DOUBLE-SIDED PEEL-OFF COUPON LAYERS

[76] Inventor: Spensar Kraige, 291 Montebello Ave., Ventura, Calif. 93004

[21] Appl. No.: 402,703

[22] Filed: Mar. 13, 1995

[51] Int. Cl.[6] ..... B42D 15/00

[52] U.S. Cl. ..... 283/51; 281/21.1; 281/38

[58] Field of Search ..... 283/51, 71, 101, 283/61, 62, 79; 402/79; 281/38, 21.1

[56] References Cited

U.S. PATENT DOCUMENTS

| | | | |
|---|---|---|---|
| 3,718,348 | 2/1973 | Bellanca | 283/101 |
| 4,685,699 | 8/1987 | Hirasawa | 283/51 |
| 4,907,904 | 3/1990 | Baldwin | 283/81 |
| 5,029,903 | 7/1991 | Pennock | 281/2 |
| 5,299,834 | 4/1994 | Kraige | 283/51 |
| 5,308,120 | 5/1994 | Thompson | 283/70 |
| 5,417,458 | 5/1995 | Best et al. | 281/51 |

*Primary Examiner*—Willmon Fridie, Jr.
*Attorney, Agent, or Firm*—Lyon & Lyon LLP

[57] ABSTRACT

A group of peel-off coupons is adhered on both sides of a thin release liner or liners. The release liner or liners are composed specifically to allow for the removable adhesion of peel-off label stock, and scored so as to be foldable. The liner or liners are stapled to a similarly-foldable protective cover for convenient and protected storage in booklet form. Thereby, a durable, compact coupon booklet of very high capacity is obtained. Also provided is a method of making double-sided peel-off coupon layers.

20 Claims, 4 Drawing Sheets

Fig. 3
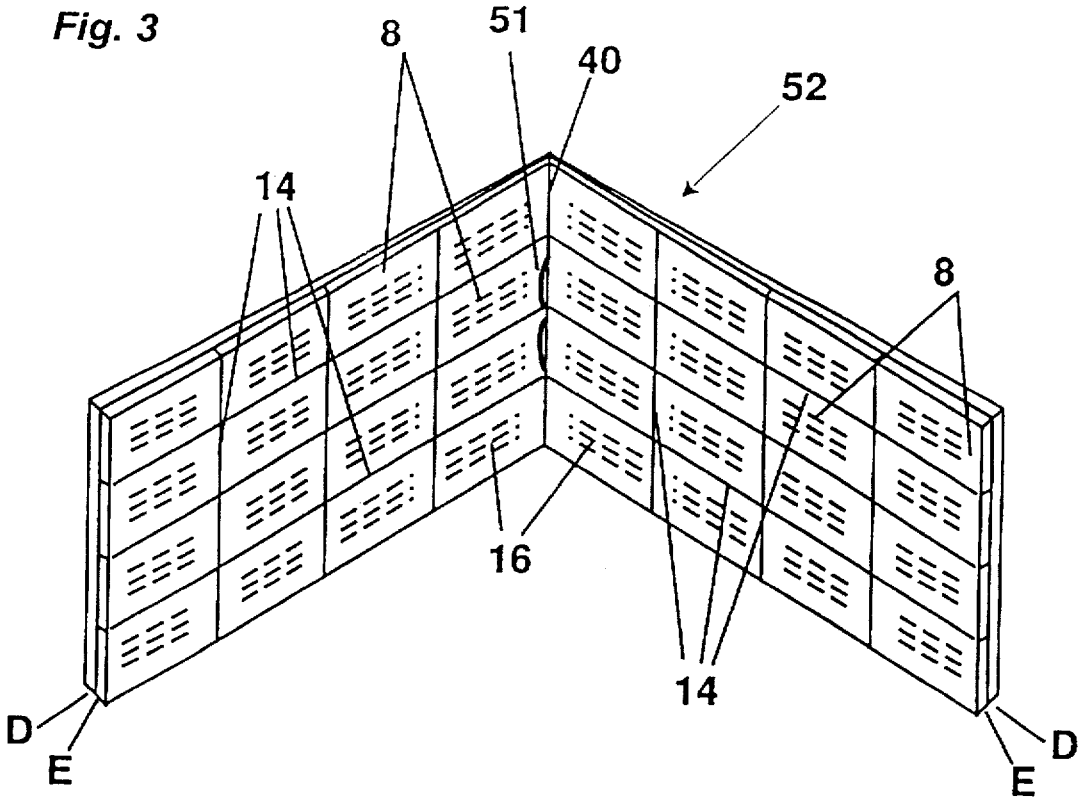
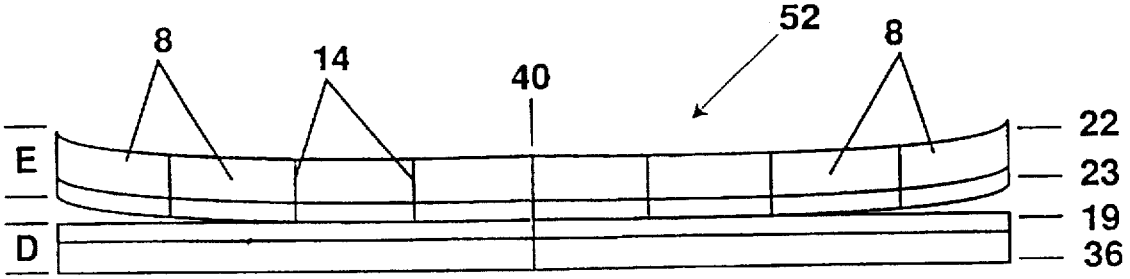
Fig. 3A

DOUBLE-SIDED PEEL OFF COUPON BOOKLET AND METHOD OF MAKING DOUBLE-SIDED PEEL-OFF COUPON LAYERS

TECHNICAL FIELD

This invention concerns the coupon arts—its purpose is to provide for the efficient manufacture and storage of coupons, and to ease the distribution, collection and handling of coupons by merchants.

BACKGROUND OF THE INVENTION

Coupons are a familiar marketing device, routinely used to promote the sale of various products and services by offering discounts or other types of effective price reduction upon presentation of the coupon to the seller. Older prior art techniques include printing coupons in newspapers and flyers from which the coupons can be cut or torn. Whatever the form of distribution, such coupon systems are all somewhat disorganized, bulky, hard for the consumer to keep track of, and difficult for the merchant to handle. These older prior art coupons are also generally inconsistent in size and shape, and time-consuming and difficult to organize and store for both the consumer and the merchant.

Another prior art coupon system is the assembling of coupons in bound books for delivery by mail or "door to door" distributors. While such coupon books and the like are more organized than consumer-created collections of individual or cut- or torn-out coupons, they are nonetheless inconvenient to carry around due to their size and weight. Further, they are costly to produce because all of the various coupons must be printed separately, perforated with tear off lines, collated, and then bound into a book. Further still, coupon books present difficulty in extracting coupons undamaged, as it is generally easy to tear the coupon itself during removal.

The development of peel-off coupon cards, as is taught in U.S. Pat. No. 5,299,834, reduced many of the above problems. The coupon card taught therein was beneficial in that it could be stored much like a credit card, and thus provided a compact form for coupons that allowed for improved facility of transport. The coupon cards, however, have a potential for unintended separation of coupons from the coupon card. More importantly, the prior art coupon cards suffer from a rather limited coupon capacity, and are somewhat bulky in thickness given the limited number of coupons they can contain (i.e., the density of coupons is relatively low).

The prior art card can be embodied in a form that alleviates the unintended separation problem, but this embodiment requires a doubling in thickness without any increase in the density of coupons. This card is similar to a standard prior art coupon card, except that it is twice the size of a credit card, and is folded in half so that the coupons face inward and are not exposed when stored. Presumably because this embodiment requires a doubling in thickness without any increase in coupon density, the embodiment does not appear to be as successful commercially as the standard single card.

Clearly, the market has evidenced a continuing desire and need for a coupon system that works effectively and consistently, and that has a higher capacity than any embodiment of the prior art card. Yet, in order for the prior art coupon cards to be conveniently inserted in, carried in, and removed from common types of receptacles (e.g., the slitted pockets in a wallet or purse), the individual cards must be fairly rigid. Using the prior art cards, the number of coupons to be transported or stored could only be increased through additional cards, all other variables held constant. But this results in an increase in the overall bulk that is proportional to any increase in the number of coupons. Decreasing the size of the individual coupons is not desirable because the coupons must be removable and manipulable by their intended users, and the printing on the coupons should be easily legible. Putting coupons on both sides of a single card could increase the coupon density to twice that of the standard embodiment of the coupon card, but if this has been tried, it has not proven successful, likely because such a configuration would unduly exacerbate the card's inherent potential for unintended separation of coupons.

The applicant, however, has discovered a new and totally different invention that solves the problem of limited coupon capacity while preventing the unintended separation of coupons. The present invention can be constructed in such a way as to allow for convenient and protected storage and transport of many more coupons in a given space than was possible with the prior art.

SUMMARY OF THE INVENTION

The present invention avoids the aforementioned problems of all of the prior art with a new and novel physical form for collections of coupons that is more dense, convenient, durable, and economical to produce. A novel and useful method of making double-sided peel-off layers is provided. The present invention further provides peel-off coupons that are placed in a folding booklet, on both sides of a relatively thin release liner or liners, so that a large quantity of coupons can be stored in a single compact booklet of credit card-profile. An outer protective cover provides durability and prevents premature separation of the coupons. In a preferred embodiment, the folded coupon booklet has about the same profile as a credit card to allow easy storage and transport in purses, wallets, and the like. Each coupon can be individually peeled from the consumer's booklet for presentation at the "point-of-sale." Since the peel-off coupons are adhesive-backed, they can then be easily and quickly reattached to a sales form maintained by the seller or merchant. Hence, a much more efficient and robust multiple coupon system is afforded, enabling more profitable fund raising activities and product promotion.

Clearly, this novel form of a coupon collection is very compact and easy for the consumer to carry on his person. Further, the individual peel-off coupons are comparatively immune to physical damage because the protective cover protects against external abuse, and because, unlike most types of prior art coupons, the present coupons virtually always separate in one piece. Even though the protective cover effectively prevents external abuse, it allows for a very high density of coupons, as the coupon-bearing double-sided release liner or liners need not be as rigid and therefore thick as the support layers of prior art coupon cards. In addition, it is not necessary that the protective cover itself be as thick as the single support layer of the prior art coupon cards, because when the booklet is folded for storage, there is more than one layer to provide the degree of rigidity necessary to allow insertion and removal of the booklet from tight storage places.

Not only is the form of coupon collection of the present invention easier to handle, less bulky and more durable than prior art coupon systems, it can also be less expensive, per coupon, to manufacture. These and other additional benefits, advantages and features will become apparent as the invention becomes better understood upon consideration of the following detailed description in conjunction with the accompanying drawings.

BRIEF DESCRIPTION OF THE DRAWING

FIG. 3 is a perspective view of the protective cover of an alternate embodiment of the coupon booklet, much thickened to facilitate clarity in the drawing, showing coupons on the inner side of the protective cover, and showing the staple and fold line;

FIG. 3A is an expanded cross-sectional fragmentary view of the double-sided coupon page insert, showing the constituents of each layer, with the layer of peel-off coupons partially peeled away;

DETAILED DESCRIPTION OF PREFERRED EMBODIMENTS

Figure 1:
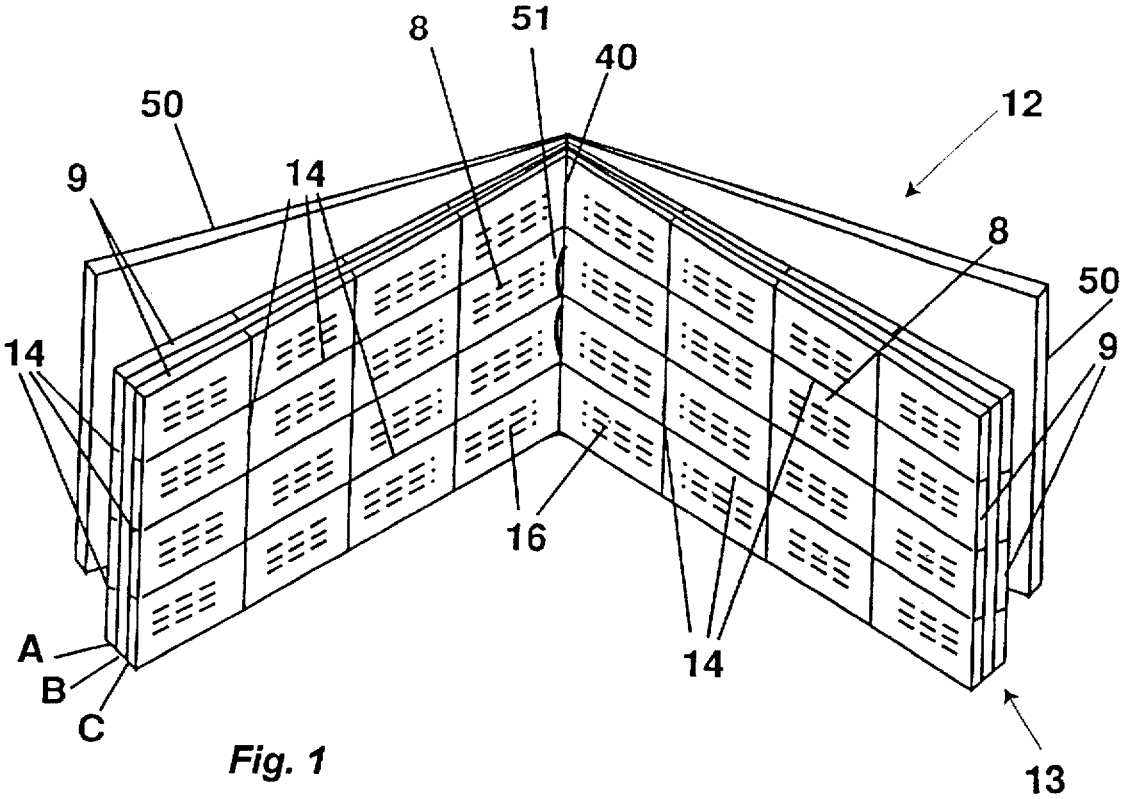
FIG. 1 is a perspective view of the coupon booklet of the present invention, much thickened to facilitate clarity in the drawing, and showing the protective cover and a coupon page insert with coupons releasably adhered on both sides thereof.

In FIG. 1, a preferred embodiment of the coupon booklet 12 is shown wherein peel-off coupons 8 are detachably arrayed on both sides of an enclosed coupon page insert 13. Although the number of coupons 8 that may reside on each page 9 of a coupon page insert 13 can vary, twelve are shown in a preferred embodiment as this has been found to be a convenient format for a credit card-profile (approximately 2"×3") booklet 12. Each of the coupons 8 have individual writing and artwork or logos printed thereon, symbolized by a myriad of randomly placed dash lines 16. The coupons 8 can be of polygonal shapes that interfit to form an array such as triangular, rectangular or hexagonal. Or, for example, pie-shaped triangular coupons can be arranged in a circle.

Figure 1A:
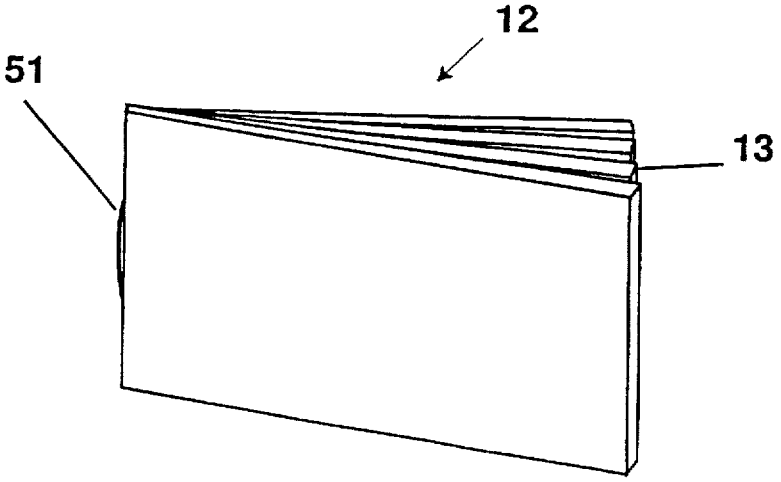
FIG. 1A is a perspective view of the coupon booklet, showing the booklet folded for storage.

Protective cover 50, which may be made of eight point paper, vinyl, polyester or impregnated stocks, is scored vertically down its center with fold line 40. Similarly, the desired number of coupon page inserts 13 are each scored with a fold line 40. Protective cover 50 is attached to coupon page inserts 13 by staple 51. Thus, as shown in FIG. 1A, coupon page inserts 13 can be enclosed and protected when the booklet 12 is folded in half for storage.

Figure 2:
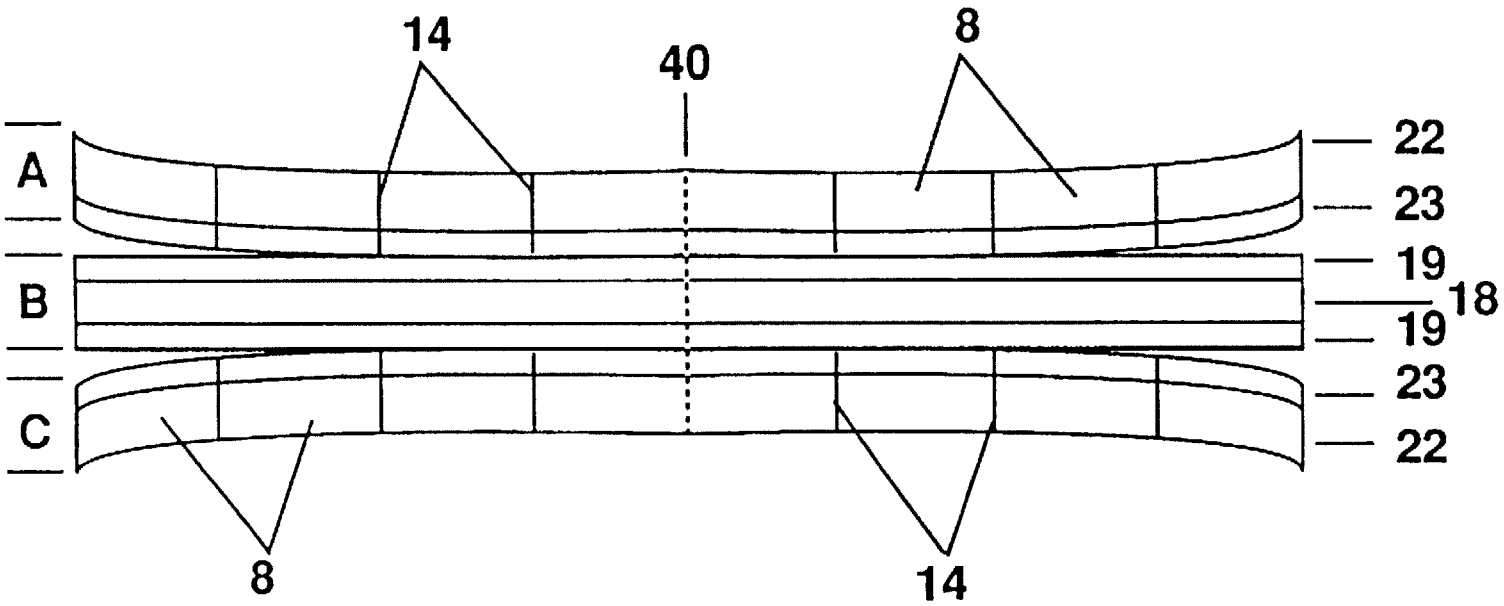
FIG. 2 is an expanded cross-sectional fragmentary view of the double-sided coupon page insert, showing the constituents of each layer, with both layers of peel-off coupons partially peeled away.

Referring now to FIG. 2, the coupon page inserts 13 comprise three main layers, "A," "B," and "C." Layer "B" is a release liner coated on both sides to accommodate peel-off coupon layers "A" and "C." Layer "A" contains an array of detachable coupons 8 and is attached to one side of the coated release liner "B." Likewise, layer "C" contains an array of detachable coupons 8 and is attached to the other side of the coated release liner "B." Both layers "A" and "C" are kiss-cut die-cut 14 as far as but not through the coated release liner "B," thereby allowing coupons 8 to be removed individually from either side of the coated release liner "B."

Coupon layers "A" and "C" are each comprised of label stock 22 (such as 60# paper, vinyl, polyester or impregnated stock), and a coating of non-drying acrylic adhesive 23. Coated release liner "B" comprises release liner stock 18 (e.g., 40# paper, vinyl, polyester or impregnated stocks) coated on both sides with a silicone release resin 19. The release resin 19 is matched specifically to the acrylic adhesive 23 so that individual coupons 8 of coupon layers "A" and "C" can be removed as desired from the coated release liner "B."

Upon separation from coated release liner "B," the coupons 8 remain coated with acrylic adhesive 23, and they can thus be easily and quickly reattached to another suitable surface, such as a sales form maintained by a seller or merchant. An inventory control and record keeping form can be of the type taught in U.S. Pat. No. 5,299,834, and should have a fairly high tack surface so that coupons 8 can be permanently adhered.

Referring to FIGS. 1 & 2, it has been found that if one coupon page insert 13 is attached to the cover 50, the release liner stock 18 is made of 40# craft paper (which has a thickness of 2.8 thousandths of an inch), and the cover 50 is made of eight point paper stock (which has a thickness of about eight thousandths of an inch), the overall thickness of the folded-in-half booklet 12 is approximately forty-two thousandths of an inch. In such an embodiment, if twelve coupons 8 are adhered to each page 9, the coupon booklet 12 holds a total of forty-eight coupons 8. Compared to a prior art peel-off card having twelve coupons and a thickness of approximately nineteen thousandths of an inch, this embodiment has nearly twice the density (for a given storage space) of coupons 8 (48/42 versus 12/19=1.81 times greater), and yet affords greater protection of the coupons 8.

If two coupon page inserts 13 are attached to the cover 50, the release liner stock 18 is made of 40# craft paper, and the cover 50 is made of eight point paper stock, the overall thickness of the folded-in-half booklet 12 is approximately sixty-two thousandths of an inch. In such an embodiment, if twelve coupons 8 are adhered to each page 9, the coupon booklet 12 holds a total of ninety-six coupons 8. Compared to a prior art peel-off card having twelve coupons and a thickness of approximately nineteen thousandths of an inch, this embodiment has more than twice the density of coupons 8 (96/62 versus 12/19=2.45 times greater), and yet affords greater protection of the coupons 8. Similarly, further increasing the number of coupon page inserts 13 results in yet higher coupon densities.

To attain greater density of coupons 8 without further additional inserts 13, an alternate embodiment of the coupon booklet 12 may be constructed with a coupon-bearing protective cover 52, shown in FIGS. 3 & 3A. Coupon-bearing protective cover 52 comprises cover layer "D" and coupon layer "E." Coupon layer "E" contains an array of detachable coupons 8 and is releasably adhered to the inner side of the cover layer "D." Coupon layer "E" is comprised of label stock 22 (such as 60# paper, vinyl, polyester or impregnated stock), and a coating of non-drying acrylic adhesive 23. Coupon layer "E" is releasably adhered to the cover layer "D" which comprises cover stock 36 (which may consist of eight point paper, vinyl, polyester or impregnated stocks) and silicone release resin 19 matched to the acrylic adhesive 23. Coupon layer "E" is kiss-cut die-cut 14 as far as but not through the coated cover stock layer "D," thereby allowing coupons 8 to be individually removed therefrom.

In this alternate embodiment, if two coupon page inserts 13 are attached to the cover 52, the release liner stock 18 is made of 40# craft paper (which has a thickness of 2.8 thousandths of an inch), and the cover 52 is made of eight point paper stock (which has a thickness of about eight thousandths of an inch), the overall thickness of the folded-in-half booklet 12 is approximately seventy thousandths of an inch. In such an embodiment, if twelve coupons 8 are adhered to each page 9, the coupon booklet 12 holds a total of 120 coupons 8, thus attaining greater coupon density (120/70 versus 12/19=2.71 times greater) while still affording the coupons 8 superior protection.

CONSTRUCTION PROCESS

Referring to FIG. 1, layers "A," "B," and "C," which together form the coupon page inserts 13, may be assembled in any sequence. After these elements are assembled, coupons layers "A" and "C" may be die-cut 14 into individual adhesive coupons 8.

Figure 4:
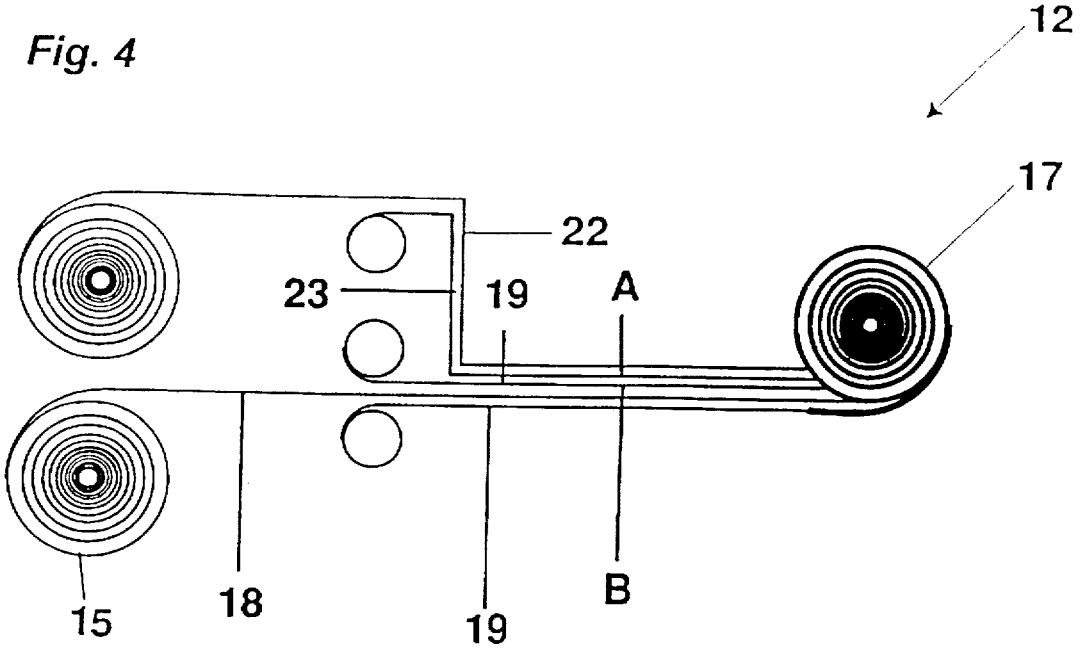
FIG. 4 is a perspective view of the construction of a double-sided coupon layer, showing the the application of an adhesive layer of coupons to the first side of a release liner, and showing the re-rolling of the resulting combination; and, FIG. 4A is a perspective view of the construction of a double-sided coupon layer, showing the the application of an adhesive layer of coupons to the second side of a release liner, and showing the cutting into sheets of the resulting double-sided coupon layer.
Figure 4A:
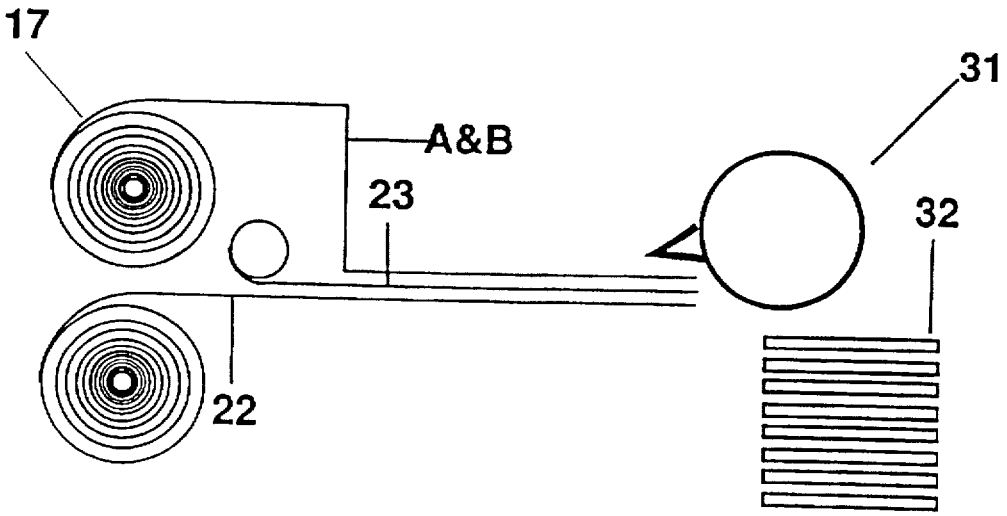

A preferred process, however, is, in significant part, illustrated in FIGS. 4 & 4A. In this process, a master roll 15 of 40# white craft paper forming the release liner stock 18 is poly-coated on both sides with a 40 gram tack silicone release agent 19, forming coated release liner "B." 60# white high gloss cast coated label stock 22 is coated with an acrylic adhesive agent 23 matched to the silicone release agent 19, forming coated label stock "A" and "C." The coated label stock "A" is then applied to the top side of the coated release liner "B" and together they are re-rolled 17. Coated label stock "C" is then applied to the bottom side of coated release liner "B" in the same fashion. This combination is then cut into flat sheets 32. Both sides of the sheets 32 are printed with artwork 16 and die-cut with a kiss-cut to form individually detachable coupons.

Referring back to FIG. 1, protective cover 50 can be cut from commercially available flat sheets of eight point paper, vinyl, polyester or impregnated stock. Protective cover 50 is then scored vertically down the center with a fold line 40.

Alternatively, a coupon-bearing protective cover 52, as shown in FIGS. 3 and 3A can be made. Commercially available flat sheets of eight point paper, vinyl, polyester or impregnated cover stock 36 are applied on one side with silicone release agent 19, forming cover layer "D," which is then cut and scored vertically down the center with fold line 40. Then the adhesive side of coupon layer "E" is releasably adhered to the side of cover layer "D" applied with release agent 19.

Referring finally to FIG. 1, the coupon page inserts 13 are each scored vertically down the center with a fold line 40. Then a staple 51 is affixed through fold lines 40, thereby securing protective cover 50 (or 52) to the coupon page inserts 13 through fold lines 40, insuring proper register in the final trimming process and adding strength to the scored fold lines 40. The final step in assembly is to trim the folded coupon booklets to the specified size, approximately 2"×3" in the case of a credit card-profiled booklet.

The result is a very durable collection of coupons with improved longevity that is compact, light, easy to carry, and inexpensive to construct. Damage to coupons is reduced and use is much easier.

Since many variations are possible without departing from the spirit and scope of the invention, I intend to be limited only to the appended claims and their equivalents.

I claim:

1. A coupon booklet comprising:

a cover having a fold line; and, a double-sided, two page coupon insert attached to the cover, comprising:

a release liner having two opposing sides;

a fold line bisecting said release liner into two pages each having two opposing sides; and, a coupon layer comprising an array of individual coupons releasably adhered to each of the opposing sides of said pages, wherein the cover and the coupon insert can be folded along their respective fold lines such that the cover will enclose and protect the coupon insert.

2. The coupon booklet of claim 1, wherein at least two coupon inserts are attached to the cover.

3. The coupon booklet of claim 1, wherein a layer of coupons is releasably adhered to the side of the cover adjacent to the enclosed coupon insert.

4. The coupon booklet of claim 1, wherein at least two coupon inserts are attached to the cover, and wherein a layer of coupons is releasably adhered to the side of the cover adjacent to the enclosed coupon inserts.

5. The coupon booklet of claim 1, wherein said booklet, when folded along said fold lines, has a profile similar to that of a standard credit card.

6. The coupon booklet of claim 1, wherein the coupon layer is cut to form an array of individually detachable coupons.

7. The coupon booklet of claim 1, wherein the coupon layer is cut to form an array of individually detachable coupons having dimensions that fit on a tracking card.

8. The coupon booklet of claim 1, wherein the release liner is of a thickness of no greater than 3.5 thousandths of an inch.

9. The coupon booklet of claim 1, wherein at least two coupon inserts are attached to the cover, and the release liner is of a thickness of no greater than 3.5 thousandths of an inch.

10. A coupon booklet comprising:

a cover having a bisecting fold line;

a double-sided, two page coupon insert, comprising:

a release liner having a bisecting fold line that bisects said liner into two pages each having two opposing sides each applied with a layer of silicone release agent;

four coupon layers each comprising a printed side and an adhesive-coated side adhered to the respective silicone release agent layer of said liner, wherein each coupon layer is cut into individually detachable coupons each of dimensions that fit on a tracking card; and, a staple attached through the fold line of the cover and through the fold line of the coupon insert such that the coupon booklet can be held open for access to and removal of the individually detachable coupons, or folded in half such that the cover will enclose and protect the coupon insert, and such that the coupon booklet approximates the profile of a standard credit card.

11. The coupon booklet of claim 10, wherein at least two coupon inserts are attached to the cover.

12. The coupon booklet of claim 10, further comprising:

a layer of silicone release agent applied to the side of the cover facing the enclosed coupon insert; and, a coupon layer comprising a printed side and an adhesive-coated side, wherein the adhesive-coated side of said coupon layer is adhered to the silicone release agent layer of said cover.

13. The coupon booklet of claim 10, further comprising:

at least two coupon inserts attached to said cover;

a layer of silicone release agent applied to the side of the cover facing the enclosed coupon inserts; and, a coupon layer comprising a printed side and an adhesive-coated side, wherein the adhesive-coated side of said coupon layer is adhered to the silicone release agent layer of said cover.

14. The coupon booklet of claim 10, wherein the thickness of the release liner is no greater than 3.5 thousandths of an inch.

15. The coupon booklet of claim 10, wherein at least two coupon inserts are attached to the cover, and wherein the thickness of the release liner is no greater than 3.5 thousandths of an inch.

16. A coupon booklet comprising:

a cover having a bisecting scored fold line;

a double-sided, two page coupon insert, comprising:

a release liner having a bisecting scored fold line that bisects said liner into two pages each having two opposing sides each applied with a layer of silicone release agent, and having a thickness of no greater than 3.5 thousandths of an inch;

four coupon layers each comprising a printed side and an adhesive-coated side adhered to the respective silicone release agent layer of said liner, wherein each coupon layer is cut into individually detachable coupons each of dimensions that fit on a tracking card; and, a staple attached through the fold lines of said cover and said coupon insert such that the coupon booklet can be held open for access to and removal of the individually detachable coupons, or folded in half such that the cover will enclose and protect the coupon insert, and such that the coupon booklet approximates the profile of a standard credit card, and has a total thickness of no greater than 100 thousandths of an inch.

17. The coupon booklet of claim 16, wherein at least two coupon inserts are attached to the cover.

18. The coupon booklet of claim 16, further comprising:

a layer of silicone release agent applied to the side of the cover facing the enclosed coupon insert; and, a coupon layer comprising a printed side and an adhesive-coated side, wherein the adhesive-coated side of said coupon layer is adhered to the silicone release agent layer of said cover.

19. The coupon booklet of claim 16, wherein forty-eight individually detachable coupons are releasably adhered to the coupon insert.

20. The coupon booklet of claim 16, wherein two coupon inserts are attached to the cover, and the overall thickness of the folded-in-half coupon booklet is approximately sixty-two thousandths of an inch.

* * * * *